United States Patent [19]

Stearley et al.

[11] B 3,989,914

[45] Nov. 2, 1976

[54] ELECTRICAL SWITCH CONSTRUCTION

[75] Inventors: John W. Stearley, Grove City; Roger L. Warner, Union Township, both of Ohio

[73] Assignee: Robertshaw Controls Company, Richmond, Va.

[22] Filed: June 9, 1975

[21] Appl. No.: 585,247

[44] Published under the second Trial Voluntary Protest Program on February 3, 1976 as document No. B 585,247.

Related U.S. Application Data

[63] Continuation of Ser. No. 298,020, Oct. 16, 1972, abandoned.

[52] U.S. Cl. ..... 200/67 D; 200/153 V

[51] Int. Cl.[2] ..... H01H 13/36

[58] Field of Search ..... 200/67 B, 67 D, 153 V

[56] References Cited

UNITED STATES PATENTS

| | | | |
|---|---|---|---|
| 2,556,981 | 6/1951 | Raney | 200/67 D |
| 3,094,594 | 6/1963 | Watson | 200/67 D |
| 3,382,332 | 5/1968 | Cherry et al. | 200/67 B |
| 3,400,234 | 9/1968 | Long et al. | 200/67 B |
| 3,485,975 | 12/1969 | Long | 200/153 V |
| 3,487,184 | 12/1969 | Arthur | 200/67 D |

*Primary Examiner*—David Smith, Jr.

*Attorney, Agent, or Firm*—Candor, Candor & Tassone

[57] ABSTRACT

In an electrical switch construction having a movable switch blade carried in the chamber of a housing and being moved between operating positions thereof by movement of an actuator, an overtravel spring engaging against the blade and the actuator for moving the blade in unison therewith as the actuator moves in unison therewith in one direction to a predetermined position relative to the housing and for thereafter preventing further movement of the blade in the one direction even though the actuator is further moved in that one direction beyond the predetermined position. A plate is carried by the housing and has a pivot arm bent therefrom at an angle relative thereto for providing a pivot for a part of the switch blade. The housing has a slot for holding the plate immediately adjacent the bent angle of the pivot arm.

8 Claims, 10 Drawing Figures

ELECTRICAL SWITCH CONSTRUCTION

This is a continuation, of application Ser. No. 298,020, filed Oct. 16, 1972, now abandoned.

This invention relates to an improved electrical switch construction and, in particular to an overtravel actuator arrangement therefor and improved means for holding a switch blade pivot arm in a fixed position relative to the switch housing.

It is well known to provide an electrical switch construction that has a movable snap switch blade means carried in the chamber of the housing means thereof and is movable between operating positions thereof by movement of an engaging actuator means.

However, it is a feature of this invention to provide a spring means for the actuator means that will engage against the blade means and move the blade means in unison therewith as the actuator means moves in unison therewith in one direction to a predetermined position relative to the switch housing and for thereafter preventing movement of the blade means in that one direction even though the actuator means is being further moved in that one direction beyond the predetermined position so that the snap blade means cannot be adversely bent by the actuator means being moved too far by the operator or the like.

Another feature of this invention is to provide means for positively holding a pivot arm for a pivot member of the switch blade in a fixed position in the housing means.

In particular, one embodiment of this invention provides an electrical switch construction having a housing means provided with a movable switch blade means. A movable actuator means is carried by the housing means for causing movement of the switch blade means between operating positions thereof upon movement of the actuator means between operating positions thereof. The actuator means has spring means for engaging against the blade means and moving the blade means in unison therewith as the actuator means moves in unison therewith in one direction to a predetermined position relative to the housing means and for thereafter preventing further movement of the blade means in one direction even though the actuator means is further moved in that one direction beyond a predetermined position thereof. A plate is carried by the housing means and has a pivot arm bent therefrom at an angle relative thereto for providing a pivot for a part of the switch blade means. The housing means has means for holding the plate immediately adjacent the bent angle of the pivot arm.

Accordingly, it is an object of this invention to provide an improved electrical switch construction having one or more of the novel features set forth above or herein after shown or described.

Other objects, uses and advantages of this invention are apparent from a reading of this description which proceeds with reference to the accompanying drawings forming a part thereof and wherein.

Figure 1:
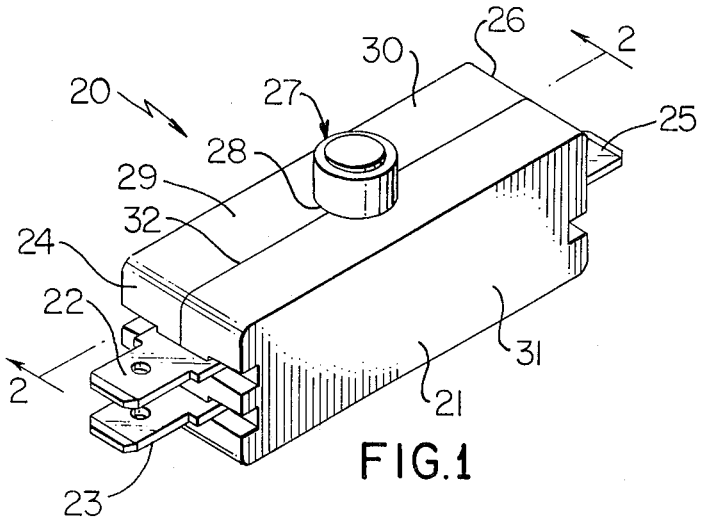
FIG. 1 is a top perspective view of the improved electrical switch construction of this invention.

While the various features of this invention are hereinafter described and illustrated as being particularly adapted to provide an electrical switch construction having a snap switch blade of a particular configuration, it is to be understood that the various features of this invention can be utilized singly or in any combination thereof to provide improved means for other types of switch blades as desired.

Therefore, this invention is not to be limited to only the embodiment illustrated in the drawings, because the drawings are merely utilized to illustrate one of the wide variety of uses of this invention.

Figure 2:
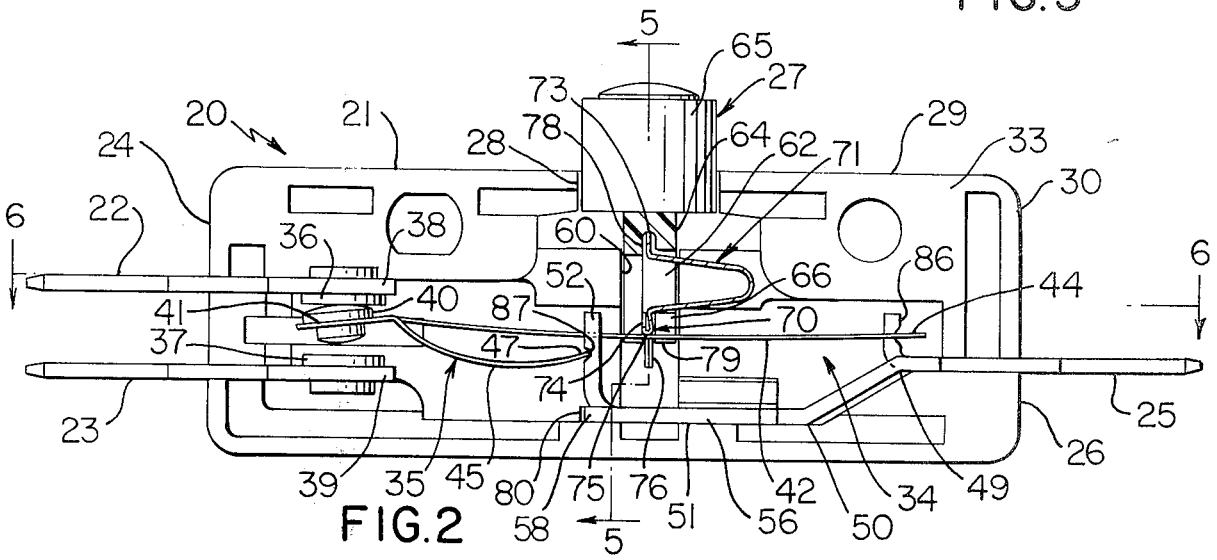
FIG. 2 is an enlarged cross-sectional view taken on line 2—2 of FIG. 1.

Referring now to FIGS. 1 and 2, the improved electrical switch construction of this invention is generally indicated by the reference numeral 20 and comprises a housing means 21 having a pair of terminals 22 and 23 projecting out of one end 24 thereof and another terminal 25 projecting out of the other end 26 thereof together with a movable actuator means 27 projecting out through an opening 28 in the top wall means 29 of the housing means 21 for effecting an electrical switching between the terminals 22 and 25 to the terminals 23 and 25 depending upon the operating position of the actuator means 27 relative to the housing means 21 in a manner hereinafter described.

The housing means 21 is formed of two like housing parts 30 and 31 suitably secured together in face-to-face relation and defining a juncture line 32 therebetween at facing sides thereof, such as facing side 33 of the housing member 30 illustrated in FIG. 2. Such housing members 30 and 31 cooperate together to define a switch chamber 34 therebetween for receiving a snap switch blade means 35 for effecting the switching function of the terminal 25 to the terminal 22 or 23 in the manner hereinafter set forth.

The terminals 22 and 23 project into the switch chamber 34 in substantially parallel spaced relation and respectively carry fixed electrical contacts 36 and 37 on the inner ends 38 and 39 thereof with the fixed contacts 36 and 37 being spaced from each other to respectively cooperate with contact means 40 carried by the movable switch blade means 35.

Figure 7:
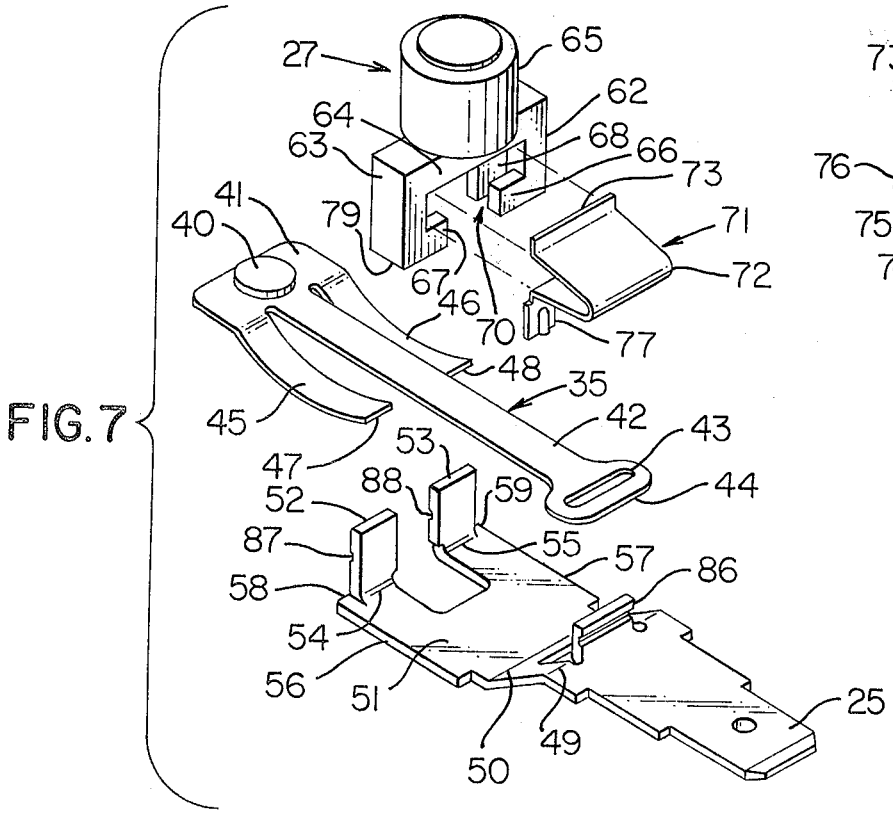
FIG. 7 is an exploded perspective view of certain parts of the electrical switch construction of FIG. 1.

The switch blade means 35 is best illustrated in FIG. 7 and includes a substantially flat rectangular part 41 that carries the contact means 40 on opposite sides thereof. A tension member, or leg 42 extends integrally from the plate part 41 and has an elongated opening 43 formed through an enlarged free end 44 thereof. A pair of compression and pivot legs 45 and 46 respectively extend from the plate part 41 of the switch blade means 35 on opposite sides of the tension member 42 with the legs 45 and 46 respectively being provided with free end edges 47 and 48.

The terminal member 25 extends into the switch chamber 34 and is suitably bent at 49 and 50 to define a flat plate 51 disposed against the bottom of the chamber 34 and having a pair of spaced pivot arms 52 and 53 respectively bent therefrom and defining bent angles 54 and 55 which are disposed spaced from each other and cause the arms 52 and 53 to be disposed substantially at right angles relative to the plate 51. The plate 51 has opposed side tongues 56 and 57 extending substantially along the entire length of the plate 51 and each having a part 58 and 59 thereof extending slightly beyond the respective bent angles 54 and 55 of the arms 52 and 53 for the purpose hereinafter described.

Figure 5:
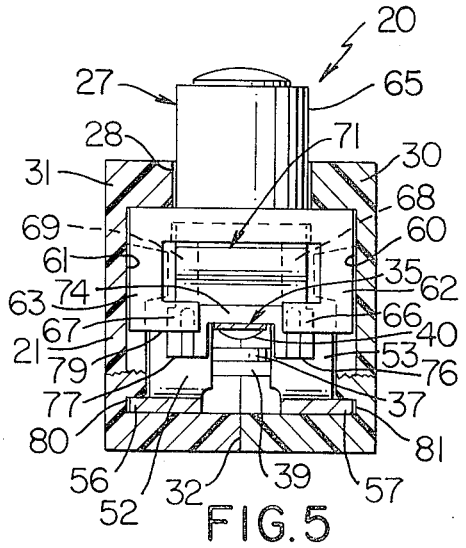
FIG. 5 is a cross-sectional view taken substantially on the line 5—5 of FIG. 2.

The housing members 30 and 31 are respectively provided with actuator guide slots 60 and 61 which are respectively adapted to receive opposed side parts 62 and 63 of the actuator means 27, the side parts 62 and 63 of the actuator means 27 being joined together at their upper ends by a bridging part 64 having a cylindrical button part 65 disposed thereon and projecting through the opening 28 in the housing means 21 in the manner illustrated in FIGS. 1 and 5. The lower ends of the side parts 62 and 63 of the actuator means 27 have inwardly directed and spaced tongues 66 and 67 respectively disposed on the right-hand side of the parts 62 and 63 as illustrated in FIG. 7 while the lefthand sides of the side parts 62 and 63 respectively have spaced and depending parts 68 and 69 not only spaced from each other but also from the adjacent parts 66 and 67 to respectively define slot means 70 therebetween for a purpose hereinafter described.

Figure 8:
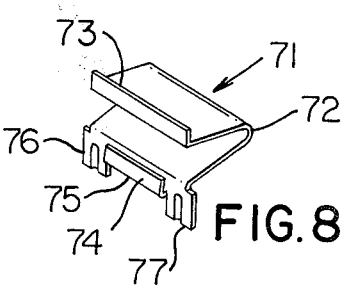
FIG. 8 is a front perspective view of the overtravel spring means of the electrical switch construction of FIG. 1.

An overtravel spring means that is generally indicated by the reference numeral 71 in FIGS. 7 and 8 is provided for the actuator means 27 and comprises a substantially flat leaf spring reversely bent to define an elbow 72 and opposed ends 73 and 74 bent in aligned vertical relation. The end 74 also is reversely bent on itself to define an arcuate lower edge 75 for a purpose hereinafter described. A pair of depending parts 76 and 77 of the leaf spring 71 extends downwardly on opposite sides of the arcuate edge 75 of the spring member 71 for a purpose hereinafter described. The leaf spring 71 is assembled to the actuator means 27 in the manner illustrated in FIG. 2 wherein the upper end 73 of the spring 71 is received in a downwardly facing notch or recess 78 formed in the cross member 64 while the end 74 and depending parts 76 and 77 respectively are received in the slot means 70 as illustrated in FIGS. 2 and 5 so that the parts 76 and 77 extend beyond the lower surface means 79 of the side parts 62 and 63 a certain amount as illustrated in FIG. 2 for a purpose hereinafter described. Thus, it can be seen that the leaf spring 71 remains assembled to the actuator means 27 as the natural bias of the reversely bent leaf spring 71 is to maintain the end 74 thereof downwardly against the inwardly turned parts 66 and 67 of the side parts 62 and 63 in the manner illustrated in FIGS. 2 and 3.

Figure 6:
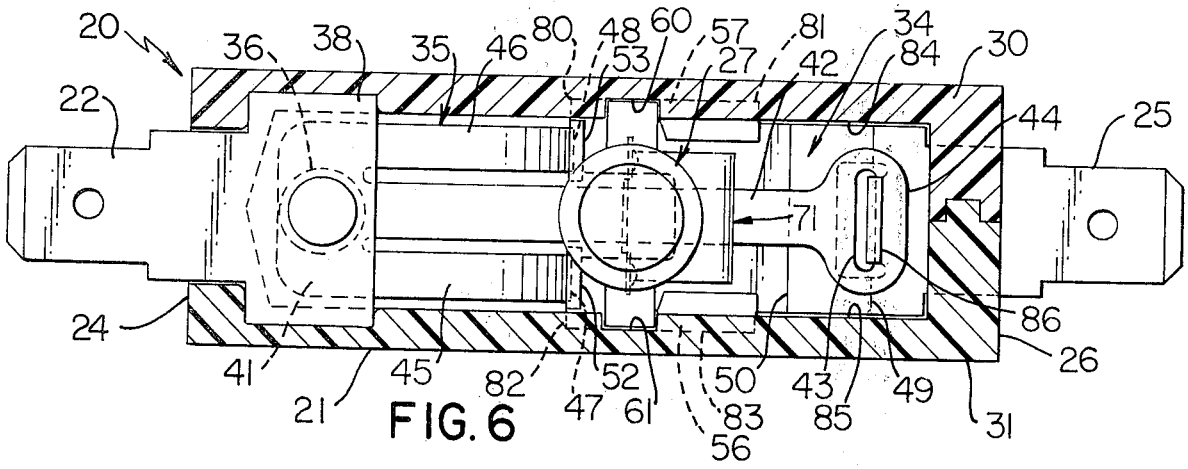
FIG. 6 is a cross-sectional view taken substantially on the line 6—6 of FIG. 2.

The housing members 30 and 31 are respectively provided with a pair of slot means 80, 81 and 82, 83 in the side wall means 84 and 85 thereof on opposite sides of the respective guide slots 60 and 61 thereof in the manner illustrated in FIG. 6 to respectively receive the side tongues 56 and 57 of the terminal plate 51 to hold the terminal plate 51 fixed in the housing means 21. However, it can be seen that the forward parts 58 and 59 of the tongues 56 and 57 that are respectively received in the front slots 82 and 80 of the housing members 31 and 30 firmly hold the plate 51 immediately adjacent the bent angles 54 and 55 of the pivot arms 52 and 53 as well as immediately at both sides of the bent angles 54 and 55 so as to positively hold the arms 52 and 53 fixed in the housing means 21 for a purpose hereinafter described.

The terminal 25 has an upstanding tongue 86 bent therefrom and which is adapted to be received through the opening 43 in the end 44 of the tension member 42 of the snap blade means 35 in the manner illustrated in FIG. 2.

The pivot arms 52 and 53 of the plate 51 respectively have notches 87 and 88 formed across the same for respectively receiving the end edges 47 and 48 of the compression and pivot members 45 and 46 of the snap blade means 35 therein as the tension member 42 is being fastened to the tongue 86 of the terminal member 25 in the manner illustrated in the drawings so that when the switch blade means 35 is assembled to the terminal 25, the member 42 is placed under tension while the pivot legs 45 and 46 are placed under compression so as to render the switch blade means 35 snap acting for a purpose hereinafter described.

With the snap blade means 35 assembled to the terminal 25 in the chamber 34 of the housing means 21, it can be seen that the actuator means 27 is so arranged in the guide slots 60 and 61 that the side parts 62 and 63 as well as the depending parts 76 and 77 of the spring means 71 straddle the tension member 42 to permit the arcuate edge 75 of the end 74 of the spring 71 to rest against the tension member 42 in the manner illustrated in FIG. 2 for a purpose hereinafter described.

Therefore, it can be seen that the switch construction 20 of this invention can be formed of relatively few parts in a simple and effective manner to operate in a manner now to be described.

The switch blade means 35 has a normal bias in the compression legs 45 and 46 thereof, as well as in the tension member 42, to normally maintain the plate part 41 in the up position illustrated in FIG. 2 wherein the contact means 40 is held out of contact with the lower contact means 37 and in contact with the upper contact means 36 so that an electrical circuit is provided between the terminals 22 and 25 because the snap blade means 35 is electrically interconnected to the terminal 25 through the tension member 42 and compression members 45 and 46 thereof making contact with the terminal 25. Also, such position of the switch blade means 35 maintains the actuator means 27 in the "up" position illustrated in FIG. 2.

Figure 3:
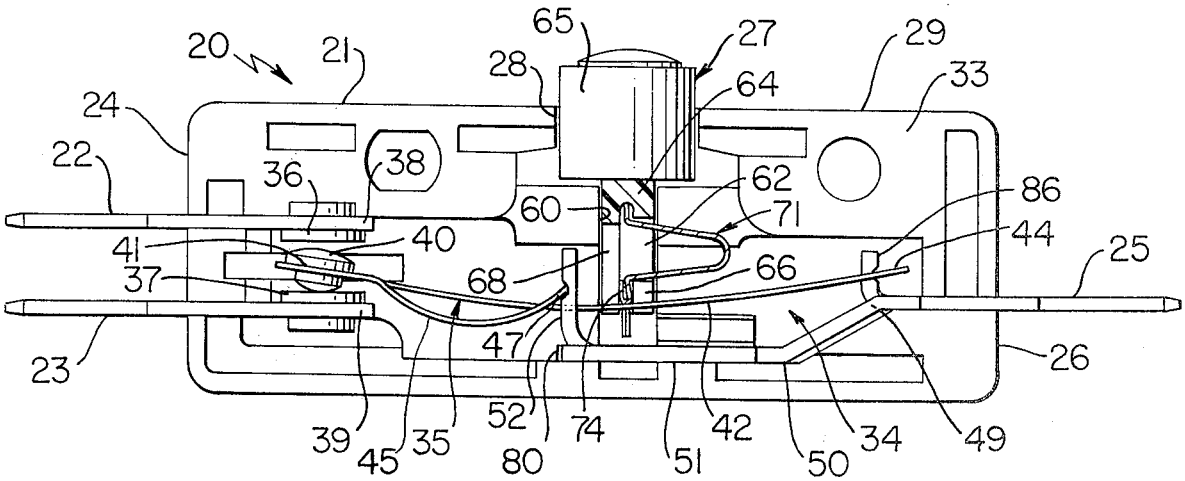
FIG. 3 is a view similar to FIG. 2 and illustrates the electrical switch construction in another operating position thereof.

However, when it is desired to switch the electrical circuit between the terminals 25 and 22 so as to be between the terminals 23 and 25, an operator pushes downwardly on the cylindrical part or button 65 of the actuator means 27 in the manner illustrated in FIG. 3 whereby the spring 71 acting on the tension member 42 moves the tension member 42 downwardly therewith in substantial unison with the actuator means 27 to cause the tension member 42 to snap over center and snap the contact means 40 out of contact with the upper contact means 36 and into contact with the lower contact means 37 as illustrated in FIG. 3.

Figure 4:
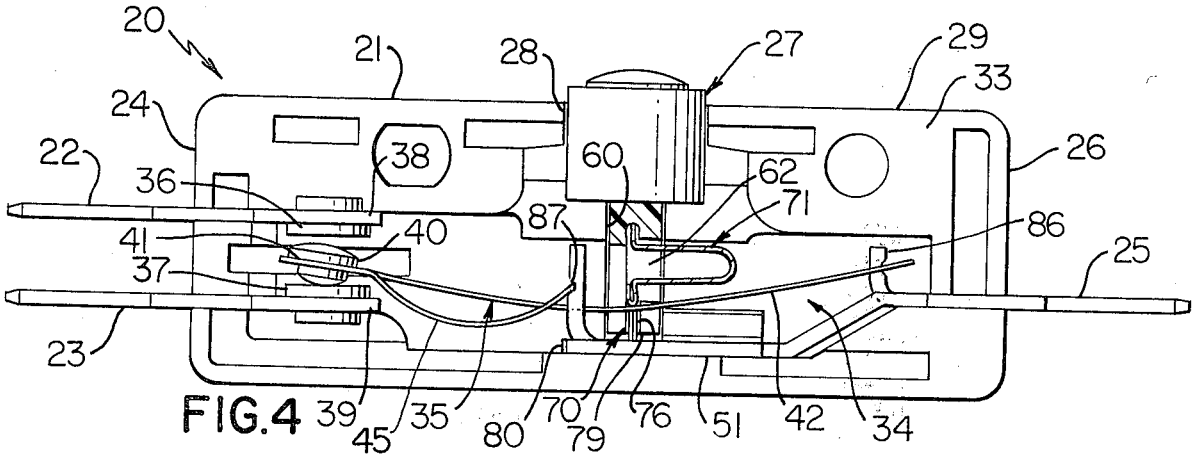
FIG. 4 is a view similar to FIG. 2 and illustrates the electrical switch construction in the overtravel actuated position thereof.

The force of the leaf spring 71 is such that the same is not compressed by the resisting force of the tension member 42 of the snap blade means 35 to effect the switching of the contact 40 from the upper fixed contact 36 to the lower contact 37 in the manner illustrated in FIG. 3. However, should the operator push downwardly on the actuator means 27 beyond the position illustrated in FIG. 3 which is a distance only required for effecting the switching operation, the depending parts 76 and 77 of the spring 71 will bottom out against the terminal plate 51 in the manner illustrated in FIG. 4 so that further downward movement of the actuator means 27 causes the leaf spring 71 to be compressed between the terminal plate 51 and the actuator means 27 whereby the switch blade means 35 is not further moved downwardly to adversely stress or effect the same as the overtravel of the actuator means 27 is now being taken up by having the leaf spring 71 be compressed in the manner illustrated in FIG. 4. In order to stop downward movement of the actuator means 27 during the overtravel thereof, it can be seen that the lower edges 79 of the side parts 62 and 63 of the actuator means 27 will eventually also bottom out also against the terminal plate 51. This bottoming out of the side parts 62 and 63 of the actuator means 27 against the terminal plate 51 would not be possible if the guide slots 60 and 61 did not extend at least down to the terminal plate 51, but it can be seen in the drawings that the same extend beyond the terminal plate 51 to assure during the assembly operation that the lower surfaces 79 of the side parts 62 and 63 of the actuator means 27 will bottom out against the terminal plate 51 should the actuator means 27 be pushed into the housing means 21 to too great an extent.

Further, since the tongues 56 and 57 of the terminal plate 51 are positively held in the slot means 80, 81, 82 and 83 of the housing members 30 and 31 on opposite sides of the respective guide slots 60 and 61, the terminal plate 51 is positively held in the housing means with the extensions 58 and 59 of the tongues 56 and 57 being positively held by the forward slots 82 and 80 of the housing member 31 and 30 immediately adjacent the fulcrum arms 62 and 53 to hold the fulcrum arms 52 and 53 from movement during the switching operation of the switch blade 35 between its operating positions by the actuator means 27.

The switch blade means 35 will remain in its down position illustrated in FIG. 3 as long as the actuator means 27 is held in its "in" position. However, upon release of the actuator means 27, the natural bias of the switch blade means 35 is to move the switch blade means 35 upwardly from the position illustrated in FIG. 3 or 4 back to the position illustrated in FIG. 2 so as to effect a snapping of the contact 40 from the lower fixed contact 37 back against the upper fixed contact 36 while moving the actuator means 27 to the "out" position illustrated in FIG. 2.

Therefore, it can be seen that the overtravel spring 71 of the actuator means 27 of this invention prevents the inward movement of the actuator means 27 beyond the position necessary to effect the switching of the switch blade means 35 from its "up" position in FIG. 2 to its "down" position in FIG. 3 from adversely effecting the switch blade means 35 as the overtravel spring 71 will bottom out against the terminal plate 51 and begin compressing to prevent further downward movement of the switchblade means 35. The actuator means 27 itself will subsequently bottom out against the terminal plate 51 to terminate the inward movement of the actuator means 27 and, thus, terminate this inward movement before any adverse condition can exist.

Further, it can be seen that the front parts 58 and 59 of the tongues 56 and 57 of the terminal plate 51 positively hold the fulcrum arms 52 and 53 fixed to the housing means 21 immediately adjacent the bent parts 54 and 55 thereof because the slots 82 and 80 of the housing means 31 and 30 extend beyond or to the left of the actuator guide slots 61 and 60 as illustrated in the drawings.

While the switch construction 20 of this invention has been previously described as only having a single switch blade therein, it is to be understood that the switch construction could be formed with a plurality of like switch blades formed therein and each having the fulcrum arms thereof held by slot means in the housing means in the same manner as the fulcrum arms 52 and 53 previously described.

Figure 9:
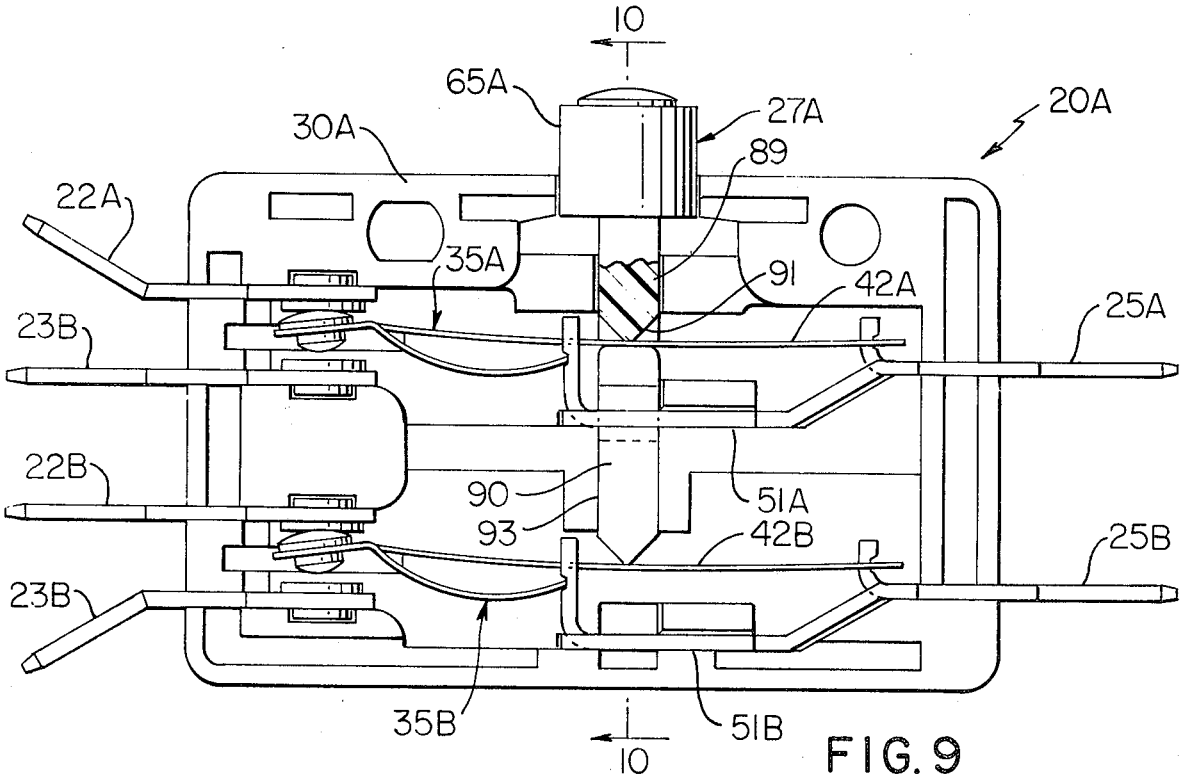
FIG. 9 is a view similar to FIG. 2 and illustrates another embodiment of the electrical switch construction of this invention.
Figure 10:
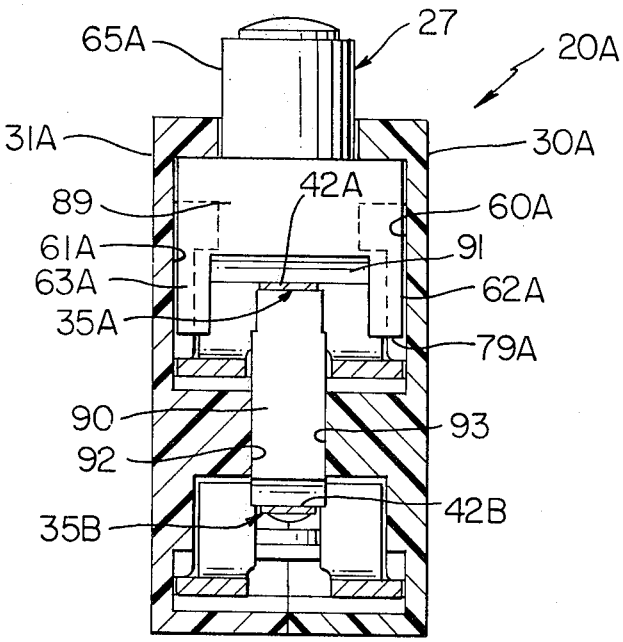
FIG. 10 is a cross-sectional view taken on line 10—10 of FIG. 9.

For example, reference is now made to FIGS. 9 and 10 wherein another electrical switch construction of this invention is generally indicated by the reference numeral 20A and parts thereof similar to the switch construction 20 are indicated by like reference numerals followed by the reference A except that the upper switch blade means and parts thereof are indicated by like reference numerals followed by the reference letter A while the lower switch blade and parts associated therewith are indicated by like reference numerals followed by the reference numeral B.

As illustrated in FIGS. 9 and 10, the switch construction 20A has the upper and lower blade means 35A and 35B, as well as the terminal means 22A, 23A and 25A and 22B, 23B, and 25B, formed in an identical manner to the like parts of the switch construction 20 wherein the pivot arms are positively held by the terminal plates 51A and 51B immediately adjacent the bent parts thereof and to the left of the actuator means 27A.

However, the actuator means 27A is formed of two parts 89 and 90, the upper part 89 including side parts 62A and 63A respectively disposed in guide slots 60A and 61A in the housing parts 30A and 31A in the manner illustrated in FIG. 10 to have its lower surfaces 79A adapted to bottom out against the upper terminal plate 51A in the manner previously described. However, the upper actuator part 89 does not have an overtravel spring 71 therein, although the same could if desired, and merely has a tapered edge 91 for engaging against the upper tension member 42A. The lower actuator part 90 extends between the upper tension member 42A and the lower tension member 42B and is respectively guided by guiding parts 92 and 93 of the respective housing member 31A and 30A in the manner illustrated in FIG. 10.

Thus, it can be seen that as the actuator means 27A is having its upper plunger part 65A pushed inwardly or downwardly as illustrated in FIGS. 9 and 10, the upper actuator part 89 has its edge 91 pushing downwardly on the tension member 42A of the upper switch blade 35A while the lower actuator part 90 is likewise being pushed downwardly by the tension member 42A to act on the tension member 42B of the lower switch blade means 35B so as to eventually snap the switch blades 35A and 35B from their "up" positions as illustrated in FIG. 9 to their "down" positions in the same manner as switch blade 25 previously described.

Therefore, it can be seen that the switch construction 20A operates substantially in the same manner as the switch construction 20 previously described except that the same does not have an overtravel spring 71 therein and the downward movement of the actuator means 27A is limited by the lower surfaces 79A of the upper actuator part 89 bottoming out on the upper terminal plate 51A.

Therefore, it can be seen that this invention provides improved electrical switch constructions or the like.

While the form of the invention now preferred has been disclosed and described as required by the patent statutes, other forms may be utilized, and still come within the scope of the appended claims.

What is claimed is:

1. An electrical switch construction comprising a housing means, a movable switch blade means carried by said housing means, and a movable actuator means carried by said housing means for causing movement of said switch blade means between operating positions thereof upon movement of said actuator means between operating positions thereof, said actuator means having spring means for engaging against said blade means and moving said blade means in unison therewith as said actuator means moves in unison therewith in one direction to a predetermined position relative to said housing means and for thereafter preventing further movement of said blade means in said one direction even though said actuator means is further moved in said one direction beyond said predetermined position, said spring means comprising a reversely bent single leaf spring member having an elbow and opposed ends, said actuator means having a chamber therein that intersects with a side slot thereof and an end slot thereof, said spring member being disposed in said chamber and having said elbow thereof extending out of said side slot and one opposed end thereof extending out of said end slot to engage said blade means.

2. An electrical switch construction as set forth in claim 1 wherein said spring member is normally compressed in said chamber between said opposed ends thereof.

3. An electrical switch construction as set forth in claim 1 wherein said one end of said spring member has a part thereof that bottoms out on said housing means when said actuator means is moved in said one direction to said predetermined position whereby further movement of said actuator means in said one direction beyond said predetermined position merely compresses said spring member in said chamber without further movement of said blade means in said one direction.

4. An electrical switch construction as set forth in claim 3 wherein the other opposed end of said spring member engages said actuator means inside said chamber.

5. An electrical switch construction as set forth in claim 4 wherein said part of said spring member extends from said one end thereof a predetermined distance beyond said blade means in said one direction.

6. An electrical switch construction as set forth in claim 5 wherein said part of said spring member comprises a pair of tangs that straddle the engaged part of said blade means.

7. An electrical switch construction as set forth in claim 1 wherein said blade means comprises a snap-acting blade means.

8. An electrical switch construction as set forth in claim 7 wherein said blade means includes a tension member thereof, said one end of said spring member engaging said tension member of said blade means.

* * * * *